US007581487B2

(12) United States Patent
Bulgarelli et al.

(10) Patent No.: US 7,581,487 B2
(45) Date of Patent: Sep. 1, 2009

(54) PRESSURE-COMPENSATING DIRECTIONAL CONTROL VALVE

(75) Inventors: Claudio Bulgarelli, Modena (IT); Massimiliano Musiani, Minerbio (IT)

(73) Assignee: Hydrocontrol S.p.A., Castel San Pietro Terme, Frazione Osteria Grande (IT)

( * ) Notice: Subject to any disclaimer, the term of this patent is extended or adjusted under 35 U.S.C. 154(b) by 294 days.

(21) Appl. No.: 11/802,596

(22) Filed: May 24, 2007

(65) Prior Publication Data

US 2008/0282691 A1 Nov. 20, 2008

(30) Foreign Application Priority Data

May 26, 2006 (EP) ..... 06425362

(51) Int. Cl.
*F15B 11/00* (2006.01)
*F15B 11/05* (2006.01)

(52) U.S. Cl. ..... 91/518; 91/446

(58) Field of Classification Search ..... 60/426, 60/456; 91/433, 446, 517, 518
See application file for complete search history.

(56) References Cited

U.S. PATENT DOCUMENTS 3,722,543 A * 3/1973 Tennis ..... 137/596.13
5,025,625 A * 6/1991 Morikawa ..... 91/518
5,038,671 A * 8/1991 Ueno ..... 91/517
5,305,789 A 4/1994 Rivolier
5,579,642 A 12/1996 Wilke et al.
5,584,227 A * 12/1996 Chung ..... 91/446

FOREIGN PATENT DOCUMENTS

DE 42 34 037 A1 4/1994
GB 1 515 914 A 6/1978

* cited by examiner

*Primary Examiner*—Thomas E Lazo
(74) *Attorney, Agent, or Firm*—Modiano & Associati; Albert Josif; Daniel J. O'Byrne

(57) ABSTRACT

A pressure-compensating directional control valve, for actuating hydraulic actuators, comprising at least one modular valve body, with one through receptacle for a slidable shuttle, a driving fluid delivery port connected to a pump, a discharge fluid port, a first output opening and a second output opening, connected to the first and second chamber, of a hydraulic actuator, at least one bridge for selective communication, by way of the shuttle, of the delivery port with the first or second chambers of the actuator, for actuation thereof, a unidirectional hydrostat connected to the bridge to draw selectively a pressure signal of the load of the actuator, the signal for adjusting selectively the delivery pressure of the pump so as to keep substantially constant the pressure drop between the delivery port and the actuator in any load condition.

9 Claims, 4 Drawing Sheets

PRESSURE-COMPENSATING DIRECTIONAL CONTROL VALVE

BACKGROUND OF THE INVENTION

The field of hydraulic systems, particularly with reference to circuits for controlling a plurality of actuators suitable to drive machines of various kinds, generally uses switching valves of the shuttle type provided with a compensating element arranged downstream. This technical solution is disclosed for example in U.S. Pat. No. 5,579,642. This compensating element is designed to keep as constant as possible the pressure drop across the control valve of the hydraulic actuator: this allows to operate the actuator with the chosen behavior. In such a case, the flow-rate delivered to the chambers of the actuator in fact depends exclusively on the passage section, which can be changed by the operator by way of the traditional means.

These switching valves are first of all typically associated with circuits for transmitting the load signal to the compensating elements; such circuits are designed to draw, by means of adapted selection valves, the highest load signal that is present in the various uses. This of course entails a certain constructive complication, which is often too expensive.

As an alternative to this, check valves are used which are directly integrated in the shuttle of the compensating element (as disclosed for example in U.S. Pat. No. 5,305,789), which in any case require the fitting of a so-called compensated "bleed-off" (which in the particular field is also known as "bleed"), which comprises a flow regulator.

A further alternative is constituted by the use of check valves fitted in parallel with respect to the compensating element, which is associated with a bleed-off.

Even these solutions, which in various situations have been optimized, are all characterized by high constructive complexity, which recommends against their use both as regards production costs and as regards installation and subsequent maintenance.

Secondly, moreover, in traditional applications the load signal is typically connected to the discharge by means of a so-called compensated bleed-off, which therefore entails installing additional hydraulic components, which considerably increase the complexity of the system.

Thirdly and finally, the load signal is usually drawn from the so-called bridge of the switching valve, and this fact entails a distinctly bulky design in the upper part of the component: in some applications, this is particularly disadvantageous.

EP-A-0 368 636 and DE 39 12 390 disclose hydraulic control systems with directional control valves having a combination of elements as set forth in the pre-characterizing portion of the appended claim 1.

SUMMARY OF THE INVENTION

The aim of the present invention is to obviate the above mentioned drawbacks, by providing a pressure-compensating directional control valve that allows to provide the effective actuation of hydraulic actuators with the desired behavior, i.e., with a preset speed, avoiding all the constructive complications and the high production costs that characterize the technical solutions that have been provided traditionally.

Within this aim, an object of the present invention is to provide a valve that is simple, relatively easy to provide in practice, safe in use, effective in operation, and has a relatively low cost.

This aim and these and other objects, which will become better apparent hereinafter, are achieved by the present pressure-compensating directional control valve, particularly for actuating hydraulic actuators, of the type that comprises at least one modular valve body, which is affected by at least one through receptacle for at least one shuttle which can slide bidirectionally, by at least one driving fluid delivery port connected to a pump, by at least one discharge port for said fluid, by at least one first output opening and by a second output opening, which are connected respectively to the first chamber and to the second chamber of a hydraulic actuator, said shuttle being controlled by remote operation means and being adapted to selectively connect said delivery port to said first output opening and said discharge port to said second output opening and vice versa, in said valve body there being further at least one bridge for the selective communication, by way of said shuttle, of said delivery port with said first chamber or with said second chamber of said actuator, so as to actuate the actuator in one direction or the other, characterized in that it comprises at least one unidirectional hydrostat, which is connected to said bridge by means of a supply duct and is adapted to draw selectively a pressure signal of the load of said actuator, said signal being designed to adjust selectively the delivery pressure of the pump so as to keep substantially constant the pressure drop between said delivery port and said actuator in any load condition.

Advantageously, said modular valve body is associated with at least one actuation head, which comprises at least one main hydrostat adapted to connect selectively, under the action of at least one contrast spring and of said load pressure signal, the delivery duct of said pump to said discharge, so as to adjust said delivery pressure to an appropriate value, which is preset according to the load.

In accordance with the invention, there is provided a pressure-compensating directional control valve, particularly for actuating hydraulic actuators, as defined in the appended claims.

BRIEF DESCRIPTION OF THE DRAWINGS

Further characteristics and advantages will become better apparent from the following detailed description of a preferred but not exclusive embodiment of a pressure-compensating directional control valve according to the invention, illustrated by way of non-limiting example in the accompanying drawings, wherein.

DESCRIPTION OF THE PREFERRED EMBODIMENTS

In the exemplary embodiment that follows, individual characteristics may actually be interchanged with other different characteristics that exist in other exemplary embodiments.

Moreover, it is noted that anything found to be already known during the patenting process is understood not to be claimed and to be the subject of a disclaimer.

Figure 1:
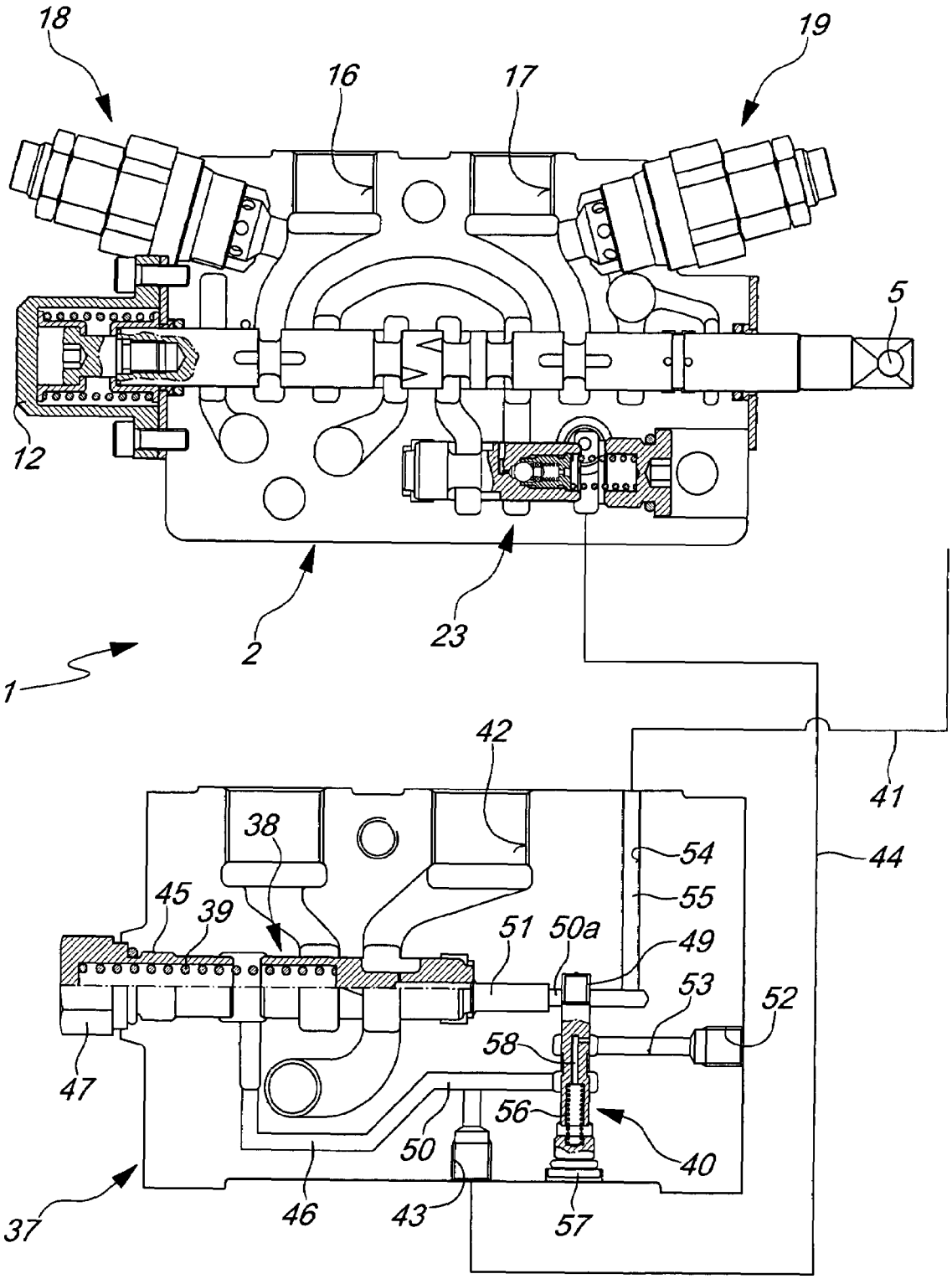
FIG. 1 is a partially sectional schematic front view of a modular valve body associated with an adjustment head, according to the invention.

With reference to FIG. 1, the reference numeral 1 generally designates a pressure-compensating directional control valve according to the invention.

The valve is preferably but not exclusively adapted to provide integrated control and management, via remote operation on the part of the operators, of the fluid-operated actuators installed in machines (for example earth-moving machines and the like), typically a series of hydraulic actuators, which are subjected to often high loads. In greater detail, the valve is designed to ensure that all the actuators of the machine can operate with a load and a speed suitable for the specific applications and in any operating condition in relation to the commands imparted by operators.

As shown in FIG. 1 and in greater detail in FIG. 2, the pressure-compensating directional control valve comprises at least one modular valve body, generally designated by the reference numeral 2, which is affected by at least one through receptacle 3, which is substantially cylindrical and has suitable cross-sections (as clarified hereinafter), and in which at least one shuttle 4 is fitted so that it can slide bidirectionally. The shuttle 4 has a first end 5, which protrudes from the modular valve body 2 and is adapted to be associated with remote operation means, which are controlled by the operator and are not shown in the figure (for example a lever, an electric valve, and others), which provide the translational motion of the shuttle 4 along its own axis in the two directions; the shuttle 4 further has a second end 6, which protrudes from the modular valve body 2 and is affected by a threaded end hole 7, in which a screw 8 for fixing a cup 9 and a complementary cup 10, provided with respective rims 9*a*, 10*a*, is engaged. The rim 9*a* of the cup 9 abuts directly against the outer surface of the valve body 2, while the rim 10*a* of the complementary cup 10 actuates a contrast spring 11, which is interposed between the cup 9 and the complementary cup 10, keeps the shuttle 4 in a preset position and contrasts its translational motion to the right with reference to FIGS. 1 and 2. The second end 6 of the shuttle 4 is covered by a protective cap 12, which is fixed to the valve body 2 by means of screws 13.

The modular valve body 2 is further affected by at least one delivery port 14 for actuation fluid (typically oil), which is connected to a hydraulic pump, which is not shown in the figures but is of a substantially traditional type, and by at least one discharge port 15 for said fluid, which is connected to the oil tank, not shown in the figures; the valve body 2 is also affected by at least one first output opening 16 and by at least one second output opening 17, which are connected respectively to the first chamber and to the second chamber of a hydraulic actuator of the double-acting type, also not shown in the figures but of a traditional type. The first output opening 16 and the second output opening 17 are associated with respective safety valves 18, 19, of a substantially traditional type, which connects the openings 16, 17 to the oil discharge if intolerable pressure peaks occur.

The shuttle 4, which as mentioned is controlled by remote operation means operated by the operator, is adapted to connect selectively, by means of its bidirectional translational motion, by way of an impulse transmitted by the operator, the delivery port 14 to the first output opening 16 and the discharge port 15 to the second output opening 17 and vice versa: this is achieved, in a substantially traditional manner, by virtue of suitable passages obtained by virtue of expansions 20, 20*a*, 20*b*, 20*c*, 20*d*, 20*e* of the diameter of the receptacle 3 in preset positions and by virtue of corresponding grooves 21, 21*a*, 21*b*, 21*c*, 21*d* provided along the outer surface of the shuttle 4. Along the shuttle 4, and in portions having a larger diameter, there are also central flow-rate control recesses 21*e* and lateral flow-rate control recesses 21*f*.

The modular valve body is also affected, in a substantially traditional manner, by at least one bridge 22 for selective communication, provided by the appropriate translational motion of the shuttle 4, alternately of the delivery port 14 with the first output opening 16 or with the second output opening 17, i.e., with one or the other of the chambers of the actuator according to the specific operating situation.

According to the invention, the valve body 2 comprises advantageously at least one unidirectional hydrostat, generally designated by the reference numeral 23, which is connected to the bridge 22 by virtue of a suitable supply duct 24, which is adapted to selectively draw a load pressure signal (so-called "load sensing") LS, to which the hydraulic actuator is subjected: said load pressure signal LS is conveniently intended to adjust selectively the delivery pressure of the pump, so as to keep substantially constant pressure drop between the delivery port 14 and the hydraulic actuator in any load condition. This allows to provide a flow-rate delivery that no longer depends on the pressure drop between upstream and downstream of the valve and on the passage section but depends exclusively on the latter: this, as it is known, allows to ensure the optimum operation of each actuator even in critical situations, such as for example situations with very high loads applied to the actuator itself, which require a high delivery pressure.

The unidirectional hydrostat 23 is engaged in a respective cylindrical seat 25, which is provided in the modular valve body 2 and is substantially parallel to the receptacle 3 of the shuttle 4. The unidirectional hydrostat 23 comprises a cylindrical slider 26, which is associated with a respective contrast spring 27, which is adapted to connect selectively the delivery port 14 to the bridge 22 across a secondary branch 28 connected to the expansion 20*c* of the receptacle 3; the contrast spring 27 of the cylindrical slider 26 is accommodated in a plug 29, which is screwed in a respective recess 30 provided in the modular valve body 2.

The unidirectional hydrostat 23 further comprises a spherical flow control element 31, which is engaged in the opening of a bush 32, which is threaded externally and is screwed into a recess 32*a* formed in the cylindrical slider 26; a contrast spring 33 of the spherical flow control element 31 is accommodated within the bush 32. A channel 34 is formed in the cylindrical slider 26 and connects the outer surface of the slider 26 to the flow control element 31 and consequently connects the supply duct of the bridge 24 to an outlet hole 35 of said valve body by means of an expansion 36 of the diameter of the cylindrical seat 25: the outlet hole 35 therefore allows to transfer the load pressures signal LS externally.

Figure 3:
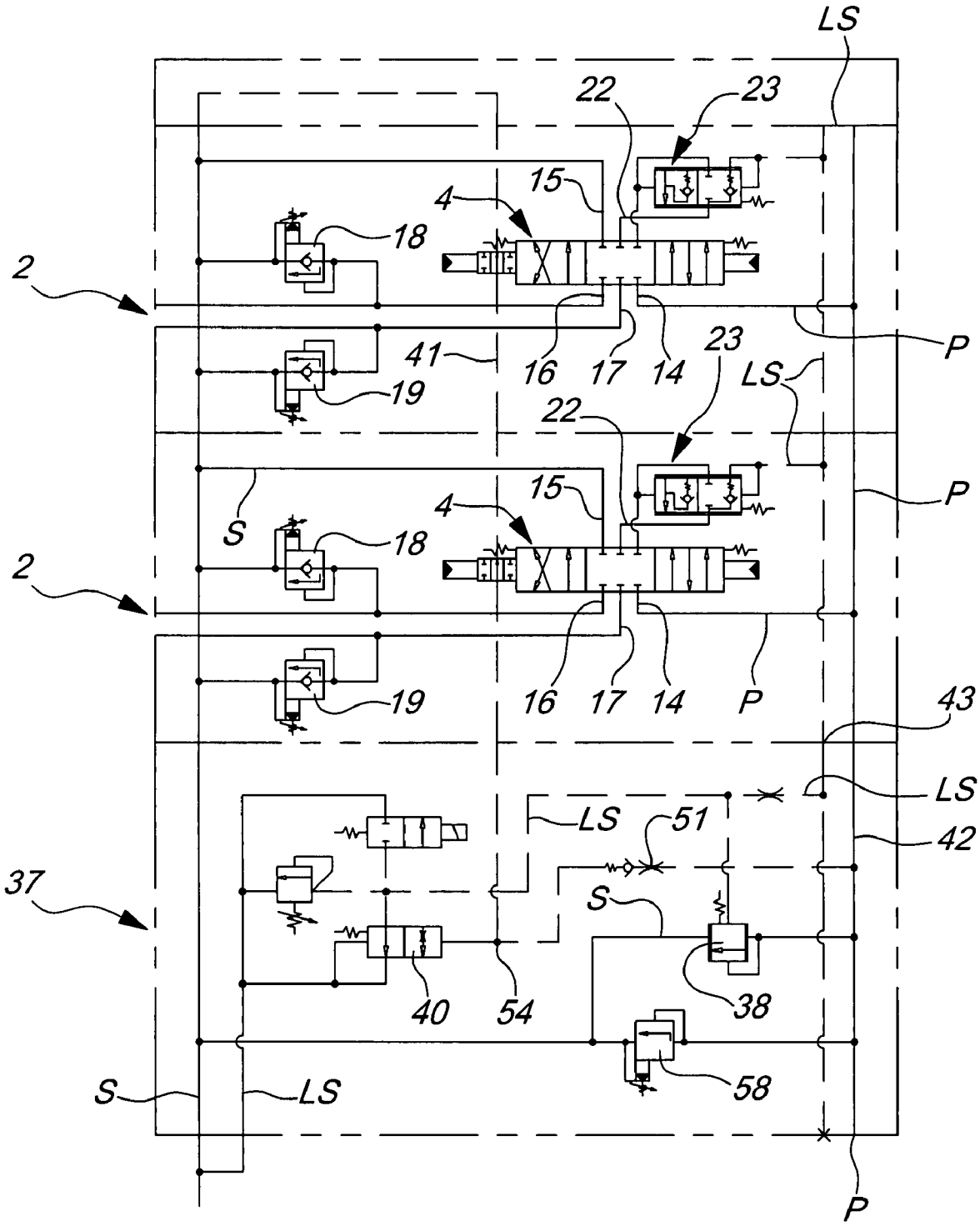
FIG. 3 is a circuit diagram of two modular valve bodies associated with an actuation head, according to the invention.

As mentioned earlier, practical applications generally use a plurality of modular valve bodies 2 fitted side by side and adapted to control the motion of respective hydraulic actuators, fitted for example on the same machine: this situation is shown in FIG. 3, with the corresponding circuit diagrams provided with the traditional symbols adopted universally in hydraulics.

Figure 2:
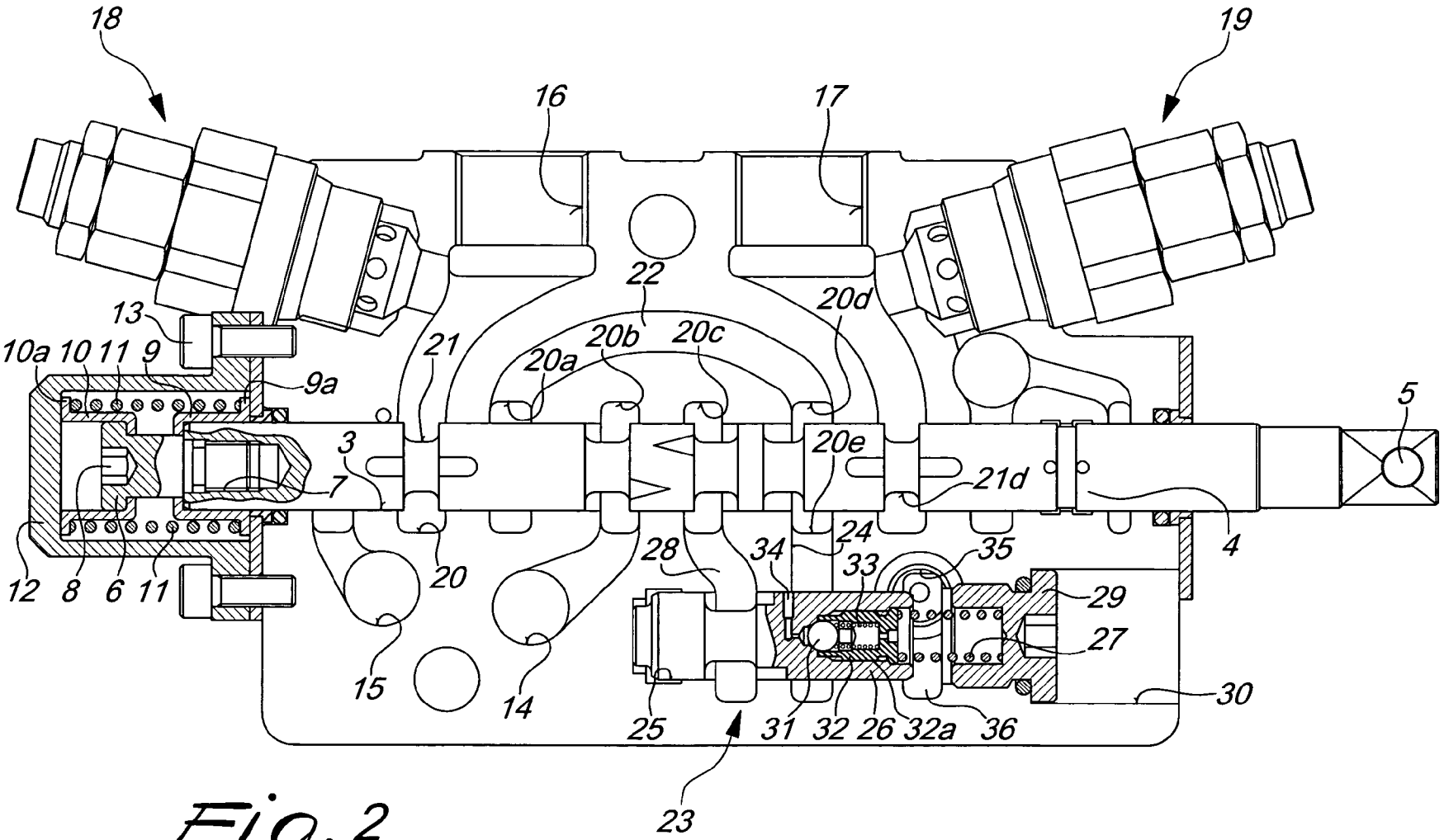
FIG. 2 is a partially sectional detail front view of a modular valve body according to the invention.

As shown by FIGS. 2 and 3, the modular valve body is, according to the invention, conveniently associated with at least one actuation head, generally designated by the reference numeral 37, which comprises at least one main hydrostat, designated by the reference numeral 38, which is adapted to connect selectively, under the action of at least one respective contrast spring 39 and of the load pressure signal LS, the delivery duct P of the pump to the discharge S, so as to adjust said delivery pressure to a suitable value which is preset in relation to the load.

The actuation head 37 comprises advantageously at least one slide valve 40, which is adapted to selectively connect the load pressure signal LS to the discharge S. Advantageously, the opening of the slide valve 40 is controlled by means of a line, designated by the reference numeral 41 in FIG. 3, which passes through each modular valve body 2 and is connected to the discharge S, so as to provide a controlled decompression of said load pressure signal: this allows to give optimum stability to the operation of the system in any load condition of all the actuators.

Figure 1A:
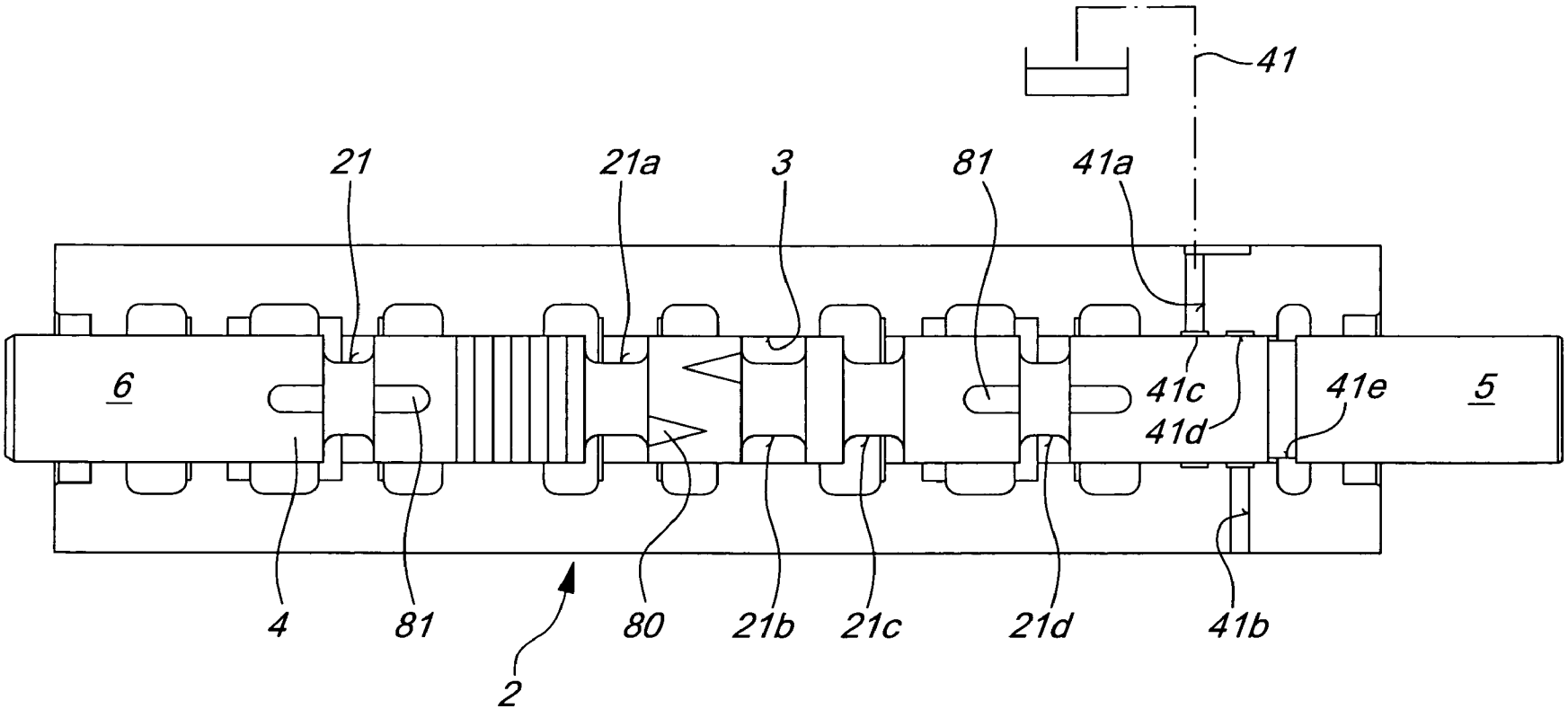
FIG. 1*a* is a partially sectional detail top view of the modular valve body.

As can be seen in FIG. 1*a*, in greater detail each modular valve body 2 is affected by a pair of holes 41*a*, 41*b* (also shown in FIG. 1 in broken lines), which allow to connect, by virtue of respecting expansions 41*c*, 41*d* of the diameter of the receptacle 3 and a groove 41*e* of the shuttle 4, the discharge S to the slide valve 40 of the actuation head 37, so as to drive the decompression of the signal LS.

The actuation head 37 comprises a substantially parallelepipedal body affected by a delivery orifice 42, which is connected to the delivery duct P, and a withdrawal orifice 43, which is connected by means of a withdrawal duct 44 to each hole 35 of each modular valve body 2, so as to transmit the signal LS of all the actuators to the actuation head 37.

The actuation head 37 forms a first cylindrical chamber 45, which accommodates the main hydrostat 38; the first cylindrical chamber 45 is connected to the withdrawal orifice 43 by means of a first branch 46. A closure plug 47 is fitted in the first cylindrical chamber 45 and has an abutment surface 48 for the helical contrast spring 39 of the main hydrostat 38.

The actuation head 37 further forms a second cylindrical chamber 49, which accommodates the slide valve 40. The second cylindrical chamber 49 is connected to the withdrawal orifice 43 by means of a second branch 50; it is further connected to the delivery orifice 42 by means of a third branch 50*a*, in which a check valve with a choke 51 is inserted.

The second cylindrical chamber 49 is further connected to an opening 52 for the discharge of the signal LS by means of a fourth branch 53 and to a driving opening 54 by means of a fifth branch 55; the driving opening 54 is connected to the line 41, as also shown in FIG. 3.

The slide valve 40 is associated with a respective contrast spring 56, which abuts against a hermetic closure element 57, and is affected by a through channel 58, which is connected to the discharge opening 52.

Finally, the actuation head 57 comprises at least one maximum pressure valve 58, which allows to connect the pump to the discharge in functional situations in which the pressure is too high.

The operation of the valve according to the invention is summarized hereinafter.

The pump delivers pressurized oil through the delivery duct P, and said oil must flow into one chamber or the other of each actuator depending on the commands imparted by the operator, which are transmitted by means of the translational motions of the shuttles 4. The shuttle 4, during its full stroke, provides a series of connections, which allow the oil, which at present is at low pressure in the secondary branch 28, to flow at a pressure defined by the load in the output openings 16, 17. In the first step of the stroke of the shuttle 4, the groove 41*e* closes the discharge circuit of the slide valve 40; a further movement of the shuttle 4 allows the load signal LS, drawn through the bridge 22 and sent to the main hydrostat 38 across the spherical flow control element 31 of the unidirectional hydrostat 23, to activate the system at the pressure of the load. At this point, with a further movement of the shuttle 4, the pressurized oil contained at the delivery port 14 flows, through the central flow-rate control recesses 21*e*, into the secondary branch 28, thus opening, when the load pressure is reached, the unidirectional hydrostat 23 and from there, across the bridge 22, to the output openings 16, 17, through the lateral flow-rate control recesses 21*f* that have opened last in the sequence of functions.

Advantageously, the load signal LS is selectively connected to the discharge by the slide valve 40, so as to ensure operating stability of the set of actuators provided in the machine.

The valve according to the invention is particularly advantageous in particular situations in which one of the actuators of the machine is subjected to a very high load: the compensation of each of the modular valve bodies in fact ensures that all the actuators of the machine are actuated independently of each other at the chosen speed.

As described, an important and considerable advantage achieved by the present invention is the presence of the slide valve 40 for managing the load signal LS, generated by the movement of the shuttle 4 across the line 41.

Further, the withdrawal of said load signal LS, and particularly the highest one among all the actuators that are present, occurs by opening the flow control element 31 provided in the unidirectional hydrostat 23 and not, as in traditional systems, by moving all the selection valves of all the sections: this last method in fact entails an inevitable delay in the transmission of the load signal LS, and consequently entails excessive slowness in starting the actuators and therefore in performing the corresponding mechanical functions.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the protection of the appended claims.

The disclosures in European Patent Application No. 06425362.8 from which this application claims priority are incorporated herein by reference.

What is claimed is:

1. A pressure-compensating directional control valve for actuating hydraulic actuators, comprising: at least one modular valve body having at least one through receptacle for at least one bidirectionally slidable shuttle, at least one driving fluid delivery port connected to a pump, at least one discharge port for the fluid, at least one first output opening and a second output opening, said first and second output opening connected respectively to a first chamber and to a second chamber of a hydraulic actuator, said shuttle being remotely controlled by remote operation means and being adapted to selectively connect said delivery port to said first output opening and said discharge port to said second output opening and vice versa; at least one bridge provided in said valve body for selective communication, by way of said shuttle, of said delivery port with said first chamber or with said second chamber of the actuator, for actuation thereof in one direction or the other; at least one unidirectional hydrostat, which is connected to said at least one bridge by way of a supply duct and is adapted to draw selectively a pressure signal of a load of the actuator, said signal being suitable to adjust selectively a delivery pressure of the pump so as to keep substantially constant the pressure drop between said delivery port and the actuator in any load condition; at least one actuation head connected with said modular valve body and comprising at least one main hydrostat, which is adapted to connect selectively, under the action of at least one contrast spring thereof and of said load pressure signal, the delivery duct of the pump to a discharge, so as to adjust said delivery pressure to a suitable value, which is preset according to said load; at least one slide valve, provided in said at least one actuation head for connecting selectively to said discharge said load pressure signal; at least one line for driving said at least one slide valve that passes through said modular valve body and is connected to said discharge, so as to provide a controlled decompression of said load pressure signal; a pair of holes provided in said modular valve body and which are adapted to connect, by way of respective diameter expansions of said at least one through receptacle and a groove of said at least one shuttle, said discharge to said slide valve of said actuation head, so as to drive a decompression of said signal.

2. The valve of claim 1, comprising said at least one actuation head and a plurality of said modular valve bodies, which are arranged mutually side by side, each suitable to actuate independently a respective hydraulic actuator.

3. The valve of claim 1, wherein said at least one unidirectional hydrostat is engaged in a respective cylindrical seat, which is provided in said at least one modular valve body and is substantially parallel to said at least one receptacle for said at least one shuttle, said at least one unidirectional hydrostat comprising at least one cylindrical slider associated with a respective contrast spring and adapted to connect selectively said delivery port to said at least one bridge.

4. The valve of claim 3, comprising: a spherical flow control element, which is engaged in a recess provided in said at least one cylindrical slider, the flow control element being associated with a respective contrast spring and being adapted to connect selectively, by way of a channel provided in said at least one cylindrical slider, said at least one bridge to a duct for drawing said load pressure signal.

5. The valve of claim 4, wherein said spherical flow control element is engaged in an opening of an externally threaded bush, which is screwed into said recess, said contrast spring of said spherical flow control element being accommodated within said bush, said channel being provided in said at least one cylindrical slider, so as to connect an external surface of said slider to said flow control element, and consequently a duct for feeding said at least one bridge to an outlet hole of said at least one valve body, by way of a diameter expansion of said cylindrical seat, said outlet hole being suitable to allow transfer of said load pressure signal externally.

6. The valve of claim 1, wherein said at least one actuation head comprises a substantially parallelepipedal body, which has a delivery orifice connected to the delivery duct, and a withdrawal opening which is connected, by way of a withdrawal duct, to an outlet hole of said at least one modular valve body, so as to transmit said signal of the actuator to said at least one actuation head.

7. The valve of claim 6, wherein said at least one actuation head forms a first cylindrical chamber, which accommodates said at least one main hydrostat and is connected to said withdrawal opening by way of a first branch, a closure plug being further provided fitted in said first cylindrical chamber and acting as an abutment for a helical contrast spring of said main hydrostat.

8. The valve of claim 7, wherein said at least one actuation head forms a second cylindrical chamber, which accommodates said slide valve and is connected to said withdrawal orifice by way of a second branch, said second cylindrical chamber being further connected to said delivery orifice by way of a third branch, that is provided therein with a check valve with a choke.

9. The valve of claim 8, wherein said second cylindrical chamber is connected to a discharge opening for said signal by way of a fourth branch and to a driving opening by way of a fifth branch, said opening being connected to said at least one line, said slide valve being associated with a respective contrast spring, which abuts against a hermetic closure element, and having at least one through channel, which is connected to said discharge opening.

* * * * *